United States Patent [19]

Baer

[11] Patent Number: 4,976,008

[45] Date of Patent: Dec. 11, 1990

[54] MULTI-PIECE THRUST BEARING ASSEMBLY FOR A HINGE STRUCTURE

[76] Inventor: Austin R. Baer, 1115 N. Ellsworth, Villa Park, Ill. 60181

[21] Appl. No.: 432,575

[22] Filed: Nov. 6, 1989

[51] Int. Cl.[5] ..... E05D 1/00

[52] U.S. Cl. ..... 16/354; 16/273; 16/DIG. 27

[58] Field of Search ..... 16/354, 273, 380, DIG. 27; 384/420

[56] References Cited

U.S. PATENT DOCUMENTS 3,092,870 6/1963 Baer ..... 16/354

3,402,422 9/1968 Baer ..... 16/366

*Primary Examiner*—Richard K. Seidel

*Assistant Examiner*—Carmine Cuda

*Attorney, Agent, or Firm*—Gravely, Lieder & Woodruff

[57] ABSTRACT

A multiple piece thrust bearing assembly for a hinge structure having two hinge members and a clamp member. The hinge members are rotatably joined along their adjacent longitudinally extending edges by intermeshing gear segments which are held together by the clamp member to permit smooth and uniform movement of the hinge members. The multi-piece thrust bearing assembly of the present invention comprises a thrust bearing member and bearing inserts arranged between the thrust bearing member and each of the hinge members for improving durability of the thrust bearing assembly and, thereby, the hinge structure. The thrust bearing member of the bearing assembly is formed from a non-metallic material which extends laterally across the hinge members to inhibit their longitudinal movement relative to each other. A first or upper pair of non-metallic bearing inserts are arranged between an upper bearing surface of the thrust bearing member and each of the hinge members to reduce frictional sliding contact therebetween. A second or lower pair of non-metallic bearing inserts are arranged between a lower bearing surface of the thrust bearing and each of the hinge members to further reduce frictional sliding contact therebetween.

12 Claims, 3 Drawing Sheets

MULTI-PIECE THRUST BEARING ASSEMBLY FOR A HINGE STRUCTURE

FIELD OF THE INVENTION

The present invention relates to pinless hinge structures and, more particularly, to an improved multi-piece thrust bearing assembly for inhibiting relative longitudinal movement between hinge members of a pinless hinge structure

BACKGROUND OF THE INVENTION

A hinqe structure normally includes two hinge members which are rotatably secured together by a pin or the like. Automatically operated doors, such as those commonly used at shopping centers, schools, or the like, are continually operated and are substantially heavier and larger than those used in most homes. As will be understood, continual use of the door submits the hinge structure to extensive wear. Notwithstanding, their continual use and the substantial load placed thereon, a hinge structure is expected to perform error free and with minimum maintenance.

Increases in height and/or weight of the door or the like carried by the hinge member, adds to the frictional sliding contact between the hinge members and thereby increases the wear on the hinge structure. As may be appreciated, and despite the wear on such hinge structures, the hinge members are not normally permitted to longitudinally move relative to each other during operation.

My U.S. Pat. No. 3,092,870, dated June 11, 1963, discloses a pinless hinge structure offering increased performance and durability. Such a hinge structure includes two longitudinally extending hinge members which are rotatably joined along adjacent longitudinal edges by intermeshing gear segments forming part of the hinge members. A clamp member maintains the gear segments in mesh relative to each other while permitting smooth and uniform movement of the hinge members through a full arc of travel of the hinge. The hinge structure can be formed from a wide variety of metals and plastic materials, and can be manufactured by extrusion, rolling, drawing, machining, molding, and other forming operations.

The design and performance of the hinge structure disclosed in the above-identified patent was further enhanced through the provision of a longitudinal thrust bearing which was the subject of my U.S. Pat. No. 3,402,422, dated Sept. 24, 1968. My patented longitudinal thrust bearing comprises an essentially solid bearing member disposed in longitudinally co-extensive recesses formed in adjacent longitudinal edges of each rotatable hinge member. The longitudinal dimensions of the bearing member and the recesses in which the bearing member is disposed are such that upper and lower surfaces of the recesses slidably contact upper and lower bearing surfaces of the bearing member disposed therein whereby inhibiting longitudinal movement of one hinge member with respect to the other hinge member.

Preferably, several thrust bearings are longitudinally spaced along the length of the door to distribute their load bearing capability. Despite their improved performance, and because of the continual relative sliding engagement against its upper and lower surfaces, such thrust bearings do, on occasion, require replacement.

Replacement of any or all of the thrust bearings normally requires complete disassembly of the hinge structure from the associated door. As will be appreciated, repairs on a door leading to a commonly frequented building such as a school, hospital, or the like interrupt or limit accessibility to such a building. Even if for only a short time period, such interruptions to building access are undesirable and therefore, should be maintained to a minimum if not eliminated. The ability to extend wearability between parts of the hinge structure will reduce maintenance costs and repairs and thereby improve hinge performance.

SUMMARY OF THE INVENTION

In view of the above, and in accordance with the present invention, there is provided a multi-piece thrust bearing assembly for a hinge structure having two hinge members which are rotatably joined along their adjacent longitudinal edges in a manner permitting smooth and uniform movement of the hinge members through a full arc of travel of the hinge structure. The multi-piece thrust bearing assembly includes a thrust bearing member which extends laterally across the hinge members to inhibit their longitudinal movement relative to each other and bearing inserts provided between the thrust bearing member and each of the hinge members for improving durability of the thrust bearing assembly and, thereby, the hinge structure.

As illustrated, the hinge members of the hinge structure are rotatably joined along their adjacent longitudinal edges by gear segments which are maintained in intermeshing engagement by a clamp member. The clamp member is configured with longitudinally extending, inwardly turned ends about which the hinge members rotate. Co-extensive lateral recesses are defined along adjacent longitudinal edges of the hinge members.

The thrust bearing member of the multi-piece thrust bearing assembly is disposed in the longitudinal recesses defined by the hinge members. The thrust bearing member extends laterally across the gear segments of the hinge members to inhibit relative longitudinal movement therebetween. In its preferred form, the thrust bearing member is formed from a non-metallic material which is configured to accommodate inwardly turned ends of the clamp member. If desired, the bearing member may be releasably secured to the clamp member as with any suitable fastener device.

To reduce frictional sliding contact between relatively movable parts of the present invention, a pair of horizontally spaced bearing inserts are arranged between each of the hinge members and an upper bearing surface of the thrust bearing member. In a preferred form, the bearing inserts each have upper and lower bearing surfaces and are inserted beneath the gear segments of each hinge member and in sliding engagement with the thrust bearing member for reducing the frictional contact between the thrust bearing member and the hinge members thereby advantageously increasing the durability of the bearing assembly Preferably, each bearing insert is formed from a non-metallic material which may be different from the non-metallic material forming the thrust bearing member and is secured to a hinge member for rotation therewith.

To further enhance durability of the bearing structure, another pair of horizontally spaced bearing inserts are arranged between lower surfaces of the recesses in the hinge members and a lower bearing surface of the thrust bearing member. Each bearing insert of the second pair is preferably disposed between and in sliding engagement with a lower bearing surface of the thrust bearing member and the gear segment of each hinge member for reducing frictional sliding contact therebetween. As with the other bearing inserts, each bearing insert of the second pair is formed from a non-metallic material which is different from the non-metallic material forming the thrust bearing member and is secured to a hinge member for rotation therewith.

The provision of the bearing inserts facilitates sliding contact between the hinge members of the hinge structure and the thrust bearing member. Because the bearing inserts and the bearing member are formed from different non-metallic materials, and because the bearing insert materials and shapes may be chosen principally for their bearing properties as a primary materials selection criterion as opposed to the selection of material on the basis of hinge member formability and durability for a different set of load conditions, the frictional sliding engagement and, thereby, wear between them is substantially reduced. Accordingly, maintenance on the thrust bearing assembly is reduced and the overall durability of the hinge structure is enhanced.

Numerous other features and advantages of the present invention will become readily apparent from the following detailed description, the accompanying drawings, and the appended claims.

DETAILED DESCRIPTION OF A PREFERRED EMBODIMENT

Figure 1:
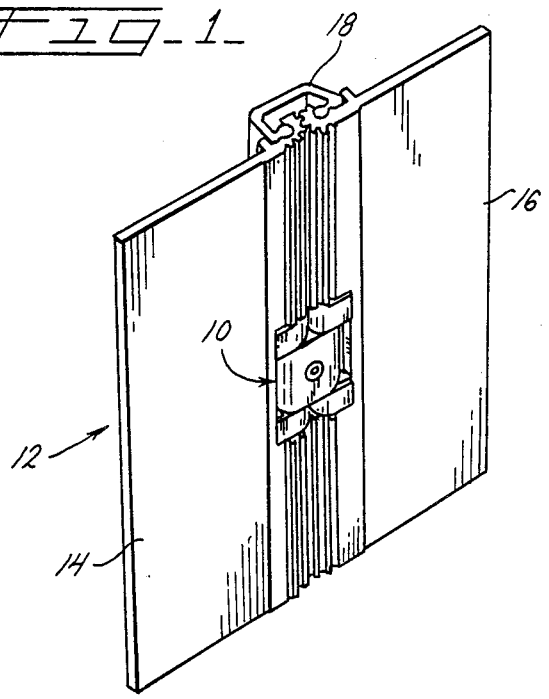
FIG. 1 is a fragmentary perspective view of an advantageous form of the multi-piece thrust bearing assembly of the present invention as arranged in combination with a hinge structure.

While the present invention is susceptible of embodiment in various forms, there is shown in the drawings, and will hereinafter be described, a preferred embodiment with the understanding that the present disclosure is to be considered as an exemplification of the invention and is not intended to limit the invention to the specific embodiment illustrated.

Referring now to the drawings, wherein like reference numerals indicate like parts throughout the several views, a multi-piece thrust bearing assembly 10 is schematically illustrated in combination with a hinge structure 12. As illustrated, the hinge structure 12 comprises first and second longitudinally extending hinge members 14, 16, respectively, which are rotatably joined along adjacent longitudinal edges. A longitudinally extendinq clamp member 18 maintains the hinge members 14 and 16 in rotatable engagement relative to each other.

Figure 2:
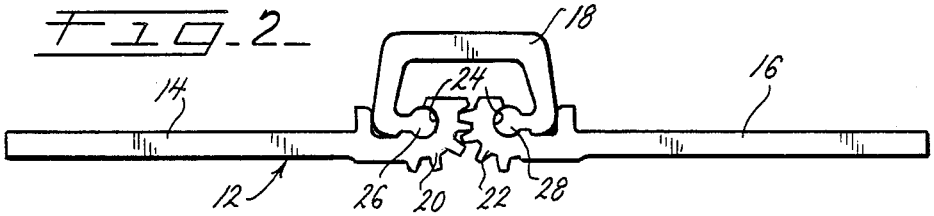
FIG. 2 is an enlarged top plan view of the hinge structure illustrated in FIG. 1.

Turning to FIG. 2, the first hinge member 14 is formed with a longitudinally extending gear segment or portion 20 at one longitudinal edge and has an outwardly extending leg portion integrally formed therewith. The second hinge member 16 is similarly formed with a longitudinally extending gear segment or portion 22 at one longitudinal edge and has an outwardly extending leg portion integrally formed therewith.

Each gear segment 20, 22 defines a longitudinally extending channel 24 which provides each gear segment with a longitudinally extending cylindrical bearing surface which coincides with the axes of rotation of the respective gear segments 20, 22. As shown in FIG. 2, the gear teeth of the gear segments 20, 22 intermesh to rotatably join the hinge members 14, 16 to each other. As will be understood, the leg portions of the hinge members are secured to door panels or the like (not shown) by any suitable fastener means such as screws or the like.

As best seen in FIG. 2, the longitudinally extending clamp member 18 has a generally channel shaped or C-shaped cross section The inwardly turned ends of the clamp member 18 are formed with longitudinally extending rod-like bearing portions 26 and 28 which contact and cooperate with the cylindrical bearing surfaces defined by channels 24 at the axis of rotation of each hinge member. Although the members which comprise the hinge structure are interconnected by the longitudinal engagement of the gear segments 20, 22 and by the longitudinal engagement of the rod-like bearing portions 26 and 28 with the channels 24 the hinge members 16 and 18 are not in any way longitudinally interconnected. As a result, there is nothing, apart from friction, to prevent relative longitudinal movement of the hinge members 14, 16 relative to each other.

The multi-piece thrust bearing assembly 10 of the present invention inhibits longitudinal movement of the hinge members 14, 16 relative to each other. As may be appreciated, more than one thrust bearing assembly may be provided along the length of the hinge structure to distribute the load bearing capability of the hinge structure over the length thereof. For purposes of discussion, however, only one thrust bearing assembly will be discussed in detail with the understanding that other thrust bearing assemblies disposed along the length of the hinge structure may be substantially similar in construction.

Figure 3:
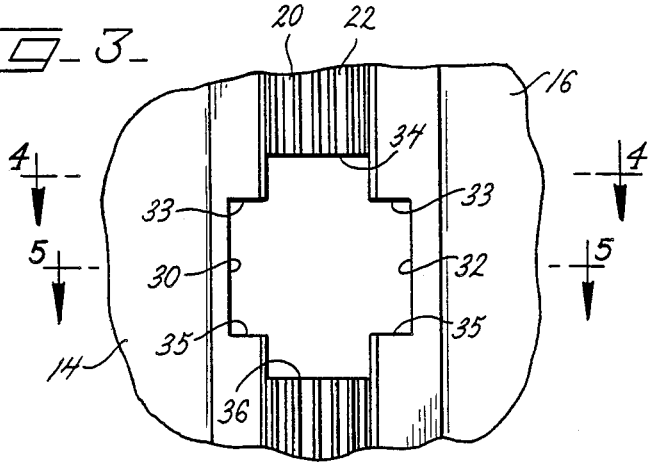
FIG. 3 is an enlarged fragmentary elevational view of the hinge structure of FIG. 1 with the multi-piece thrust bearing assembly of the present invention removed therefrom.

Turning now to FIG. 3, the hinge members 14, 16 define longitudinally co-extensive lateral recesses 30 and 32, respectively, along adjacent longitudinal edges thereof. As illustrated, each of the recesses 30, 32 has a stepped profile which is the mirror image of the other.

Figure 4:
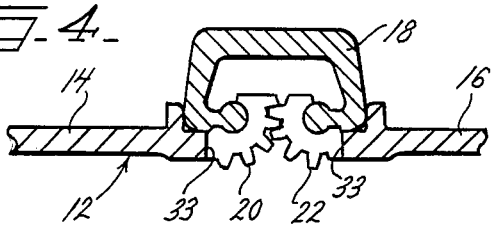
FIG. 4 is a sectional view taken along line 4—4 of FIG. 3.
Figure 5:
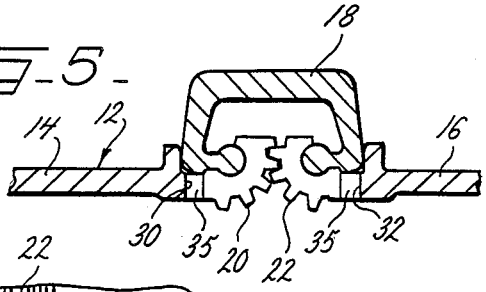
FIG. 5 is a sectional view taken along line 5—5 of FIG. 3.

In the illustrated embodiment, the stepped profile of the recesses 30, 32 includes upper and lower laterally extending surfaces 34 and 36, respectively. As illustrated in FIGS. 3, 4 and 5, the stepped profile of each recess 30, 32 is further defined by providing each hinge member 14, 16 with laterally extending upper and lower shoulder portions 33 and 35 which are aligned with and vertically spaced from each other.

Figure 6:
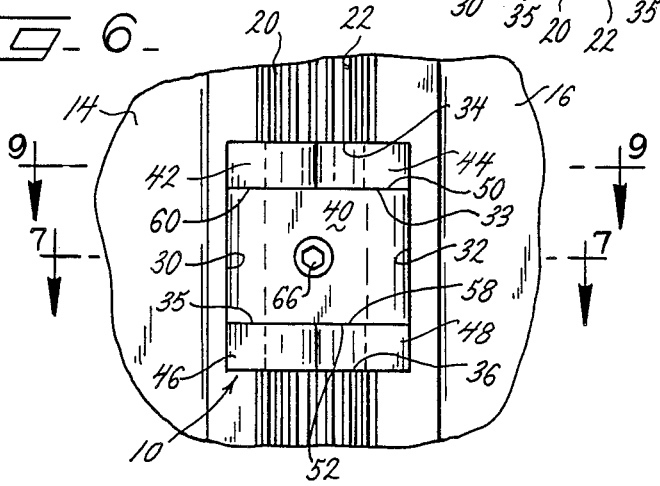
FIG. 6 is an enlarged fragmentary elevational view of the multi-piece thrust bearing assembly of the present invention arranged in combination with the hinge structure.

As illustrated in FIG. 6, the multi-piece bearing assembly 10 of the present invention is disposed within the lateral recesses 30, 32 defined by the hinge members and includes a thrust bearing member 40 preferably having bearing inserts or pieces 42, 44, 46 and 48 arranged in combination therewith. As illustrated, bearing inserts 42, 44 define a first or upper pair of bearing inserts while bearing inserts 46 and 48 define a second or lower pair of bearing inserts.

The longitudinal dimension between the upper and lower surfaces 34, 36, respectively, of each of the recesses 30, 32 formed in the adjacent longitudinal edges of the hinge members 14, 16, respectively, and the cumulative longitudinal dimension of the thrust bearing member 40 and bearing inserts 42 through 48 comprising the bearing assembly 10 are such that there is just sufficient clearance therebetween to permit the hinge members 14, 16 to swing or to be rotated in an arcuate path of travel without binding on the bearing assembly.

Figure 7:
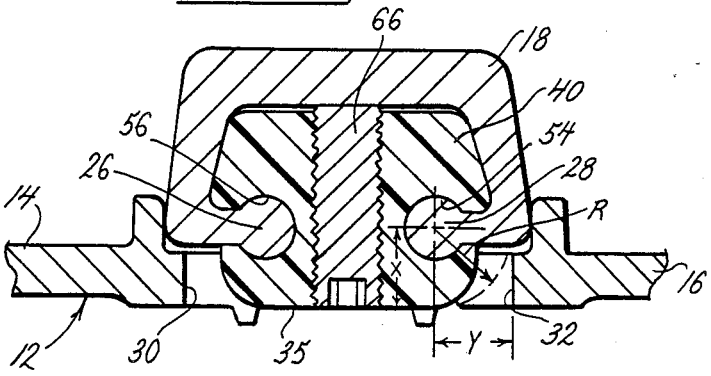
FIG. 7 is a sectional view taken along line 7—7 of FIG. 6.

In the illustrated embodiment, the longitudinal distance between the lowermost edge of each shoulder portion 33 and the uppermost edge of an aligned shoulder portion 35 is equal to or greater than the longitudinal dimension of the thrust bearing member 40. As illustrated in FIG. 7, that portion of each of the recesses 30, 32 defined between the upper and lower shoulder portions laterally extends outwardly from the central axis of the closest rod-like portion of the clamp member 18 a predetermined distance "Y". The predetermined distance "Y" is equal to or greater than the distance "X" which is equivalent to the distance the longitudinally extending face 35 of bearing member 40 extends away from the central axis of the rod-like portions on the clamp member 18. Therefore, when either hinge member 14, 16 is moved between open and closed positions, there is sufficient clearance defined by radius "R" between the recesses 30, 32 and the bearing member 40.

As illustrated in FIG. 6, the thrust bearing member 40 is provided with upper and lower bearing surfaces 50, 52, respectively, against which the bearing inserts slidably bear when the bearing assembly 10 is received in the recesses 30, 32 of the hinge members 14, 16, respectively. The thrust bearing member 40 is formed from a non-metallic material such as an acetal resin-type plastic. Such material is commonly sold under the trade name "Delrin" by DuPont Corporation. Moreover, the thrust bearing is configured to rotatably accommodate inwardly turned ends of the clamp member 18.

Figure 8:
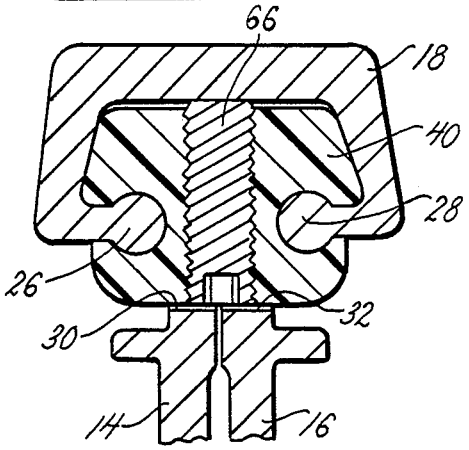
FIG. 8 is a sectional view similar to FIG. 7 with the hinge members of the hinge structure rotated into a closed position.

As illustrated in FIGS. 7 and 8, the thrust bearing member 40 advantageously has a cross-sectional configuration that conforms essentially to the cross-sectional configuration of the interior clamp member 18. The cross-sectional configuration of the thrust bearing member 40 offers relatively large planar surface areas for supporting the associated bearing inserts whether the hinge members are in an open position (FIG. 7) or a closed position (FIG. 8). Thrust bearing member 40 further defines a pair of longitudinally extending channels 54 and 56 that receive the rod-like bearing portions 26 and 28, respectively, of the clamp member 18 and through which these rod-like bearing portions longitudinally extend.

Figure 9:
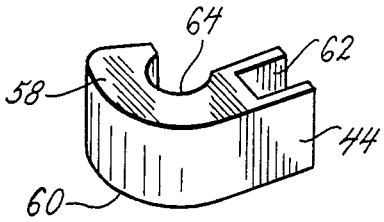
FIG. 9 is a perspective view of a bearing insert forming part of the present invention.

Each of the bearing inserts 42 through 48 are substantially similar to each other. As illustrated in FIG. 9, each bearing insert has a generally J-shaped configuration and includes upper and lower planar bearing surfaces 58 and 60, respectively. Each bearing insert is preferably formed from a non-metallic material which is different from the material used to form the thrust bearing material Moreover, each bearing insert defines a channel 62 which is preferably configured to embrace a shoulder portion on each hinge member such that each insert rotates with an associated hinge member about an inwardly turned end of the clamp member 18.

Figure 10:
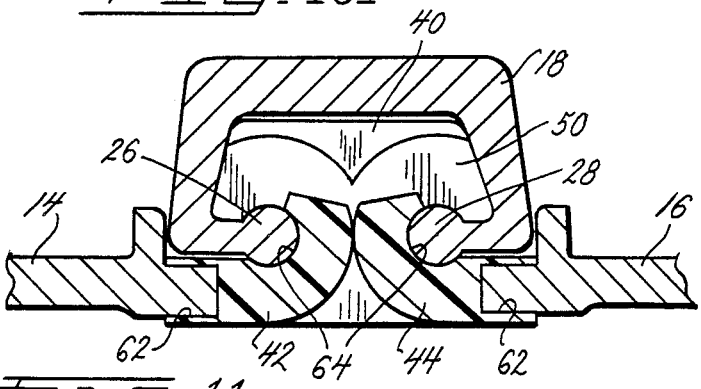
FIG. 10 is a sectional view taken along line 10—10 of FIG. 3.
Figure 11:
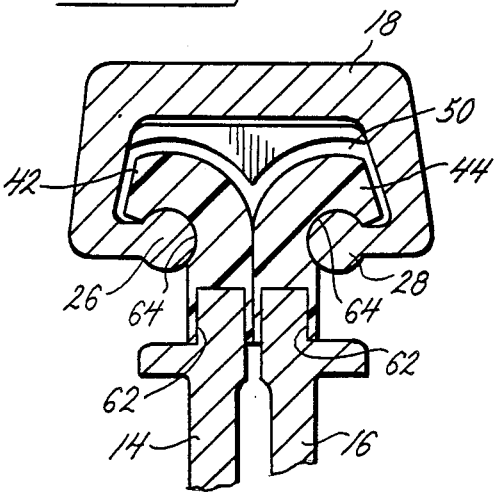
FIG. 11 is a sectional view similar to FIG. 10 with the hinge members of the hinge structure rotated into a closed position.

As illustrated in FIGS. 9, 10 and 11, each bearing insert is provided with a longitudinally extending channel 64. Channel 64 provides a bearing surface which allows each insert to embrace and rotate about a rod-like portion of the clamp member.

Returning to FIGS. 6, 7 and 8, the clamp member 18 may be secured to the thrust bearing member 40 to avoid inadvertent longitudinal movement of clamp member 18 relative to the hinge members. To effect such ends, a releasable fastener 66 in the form of a set screw or the like bears against the inner surface of the clamp member 18 to inhibit relative longitudinal movement therebetween. Understandably, other means for securing the thrust bearing member 40 to the clamp member 18 can be employed such, for example, as by swaging or punching or adhesively connecting the parts together, or by attaching thrust bearing 40 to clamp member 18 by a rivet or threaded fastener.

In operation, the thrust bearing member 40 is disposed within the lateral recesses 30, 32 and extends laterally across adjacent longitudinal edges of the hinge members 14, 16 so as to effectively prevent relative longitudinal movement between the hinge members. A salient feature of the present invention being the ability of the thrust bearing assembly 10 to reduce sliding frictional engagement between non-metallic surfaces on the hinge members in a manner increasing wearability and, thereby, durability of the hinge structure. To effect such ends, the bearing inserts 42 through 48 are provided in combination with the thrust bearing member 40.

The upper pair of bearing inserts 42 and 44 are arranged in the lateral recesses 30, 32 beneath the gear segments 20, 22 of the hinge members 14, 16, respectively, and the upper surface 50 of the thrust bearing member 40. As illustrated in FIGS. 10 and 11, as the hinge members 14, 16 rotate, the associated upper bearing inserts 42, 44 will rotate therewith. Upon rotation of either hinge member, the non-metallic lower bearing surface 60 (FIG. 6) of the bearing inserts 42 and 44 slidably bear against the non-metallic upper surface 50 of the thrust bearing member 40 in a manner enhancing hinge performance by reducing frictional sliding contact between the hinge members and the bearing means 10. Moreover, forming the bearing inserts 42, 44 from a non-metallic material, such as nylon, which is different from the non-metallic material used to form the thrust bearing member 40 will reduce sliding frictional contact therebetween.

Likewise, the lower pair of bearing inserts 46 and 48 are arranged in the lateral recesses 30, 32 beneath the lower surface 52 of the thrust bearing member 40 and the upper surface 36 of the recesses above the gear segments 20, 22 of the hinge members 14, 16 respectively. As the hinge members 14, 16 rotate, the associated lower bearing inserts 46 and 48 will rotate therewith. Upon rotation, the non-metallic lower bearing surface 52 of the thrust bearing member slidably bears against the non-metallic upper bearing surface 58 of each lower bearing insert in a manner enhancing hinge performance by improving sliding contact between the hinge members and the bearing means Moreover, forming the bearing inserts 46, 48 from a non-metallic material, such as nylon, which is different from the non-metallic material used to form the thrust bearing member 40 will reduce sliding frictional contact therebetween.

The present invention further contemplates connecting the upper bearing inserts 42 and 44 to the lower bearing inserts 46 and 48, respectively, in longitudinally spaced relation equal to the longitudinal dimension of the thrust bearing member 40 to facilitate assembly of the thrust bearing assembly 10 within the recesses 30, 32 of the hinge members. The connection between the bearing inserts may be in the form of a longitudinally extending connector having frangible or weakened lines of connection to each of the bearing inserts such that the connector will easily break off from or otherwise become dissociated with the bearing inserts upon initial operation of the hinge members.

This invention has been described in terms of specific embodiments set forth in detail, but it should be understood that these are by way of illustration only and that the invention is not necessarily limited thereto. Modifications and variations will be apparent from the disclosure and may be resorted to without departing from the spirit of the invention, as those skilled in the art will readily understand. Accordingly, such variations and modifications of the disclosed products are considered to be within the purview and scope of the invention and the following claims.

What is claimed is:

1. A multi-piece thrust bearing assembly for a pinless hinge structure including two intermeshed geared hinge members which are longitudinally movable relative to each other and a clamp member for maintaining the geared hinge members in mesh as they rotate, each geared hinge member including a gear segment extending along a longitudinal edge thereof, and an outwardly extending leg portion, said bearing assembly comprising:

bearing means disposed in adjacent longitudinal co-extensive lateral recesses defined along adjacent longitudinal edges of each hinge member and extending laterally across each gear segment of said hinge members to inhibit longitudinal movement of the hinge members relative to each other; and bearing insert means arranged beneath the gear segment of each hinge member and an upper bearing surface of said bearing means and secured to said hinge members for enhancing hinge performance by reducing frictional sliding contact between the hinge members and said bearing means.

2. The multi-piece bearing assembly according to claim 1 wherein said bearing insert means includes a pair of bearing inserts both formed from a non-metallic material.

3. The multi-piece bearing assembly according to claim 1 wherein said bearing means is formed from a non-metallic material and is configured to accommodate an inwardly turned end of said clamp member.

4. The multi-piece bearing assembly according to claim 3 wherein said bearing insert means includes a pair of side by side bearing inserts, each bearing insert being formed from a non-metallic material which is different from the non-metallic material forming said bearing means and which is configured to rotatably engage an inwardly turned end of said clamp member.

5. A multi-piece thrust bearing assembly for a pinless hinge structure including two rotatable hinge members and a clamp member, said hinge members being longitudinally movable relative to each other and are rotatably joined along adjacent longitudinal edges by intermeshing gear segments forming part of and which allow said hinge members to longitudinally move relative to each other with said clamp member maintaining the gear segments in mesh, said multi-piece thrust bearing assembly comprising:

bearing means disposed in longitudinally co-extensive lateral recesses defined by each of said hinge members along said longitudinal edges, said bearing means extending across the adjacent longitudinal edges of said hinge members to inhibit longitudinal movement of said hinge members relative to each other; and non-metallic insert means secured to said hinge members and arranged between opposite ends of said bearing means and upper and lower surfaces of the recesses defined by said hinge members for enhancing hinge performance by improving sliding contact between the hinge members and said bearing means.

6. The multi-piece bearing assembly according to claim 5 wherein said insert means defines upper and lower generally planar bearing surfaces, with one bearing surface abutting with said bearing means and the other bearing surface abutting against a surface of the recess defined by said hinge member.

7. The multi-piece bearing assembly according to claim 5 wherein said insert means defines a longitudinally extending channel which rotatably engages an inwardly turned end of said clamp member.

8. The multi-piece bearing assembly according to claim 5 wherein said insert means has a generally J-shaped lateral cross-sectional configuration.

9. The multi-piece bearing assembly according to claim 5 wherein said clamp member is secured to said bearing means.

10. The multi-piece bearing assembly according to claim 5 wherein said bearing means is formed from a non-metallic material and defines two spaced apart longitudinally extending channels, each channel accommodating an inwardly turned end of said clamp member.

11. The multi-piece bearing assembly according to claim 10 wherein said non-metallic insert means includes bearing surfaces formed with material which is different from the material used to form said bearing means.

12. The multi-piece bearing assembly according to claim 11 wherein said bearing means is formed from an acetal resin-type plastic and the bearing surfaces on said non-metallic insert means are nylon.

* * * * *

US004976008B1

REEXAMINATION CERTIFICATE (3061st)

United States Patent [19]

Baer

[11] B1 4,976,008

[45] Certificate Issued Nov. 26, 1996

[54] MULTI-PIECE BEARING ASSEMBLY FOR A HINGE STRUCTURE

[75] Inventor: Austin R. Baer, Villa Park, Ill.

[73] Assignee: Roton Barrier, Inc., St. Louis, Mo.

Reexamination Request:
No. 90/003,754, Mar. 20, 1995

Reexamination Certificate for:

| | |
|---|---|
| Patent No.: | **4,976,008** |
| Issued: | **Dec. 11, 1990** |
| Appl. No.: | **432,575** |
| Filed: | **Nov. 6, 1989** |

[51] Int. Cl.[6] ..... E05D 7/00

[52] U.S. Cl. ..... 16/354; 16/273; 16/DIG. 27

[58] Field of Search ..... 16/354, 273, DIG. 27, 16/380

[56] References Cited

U.S. PATENT DOCUMENTS

| | | |
|---|---|---|
| 83,062 | 10/1868 | Hover . |
| 179,409 | 7/1876 | Hopkins . |
| 293,796 | 2/1884 | Shepard . |
| 340,688 | 4/1886 | Van Slyke . |
| 368,539 | 8/1887 | Ludlow . |
| 498,564 | 5/1893 | Morris . |
| 2,546,590 | 3/1951 | Ferrel . |
| 2,668,320 | 2/1954 | Lustig . |
| 3,092,870 | 6/1963 | Baer . |
| 3,374,499 | 3/1968 | Horstman . |
| 3,402,422 | 11/1968 | Baer . |
| 3,422,487 | 1/1969 | Dickinson . |
| 3,483,588 | 12/1969 | Hover . |
| 3,499,183 | 3/1970 | Parsons . |
| 3,725,973 | 4/1973 | Gwozdz . |
| 3,787,923 | 1/1974 | Peterson . |
| 3,881,221 | 5/1975 | Schmidt . |
| 3,921,225 | 11/1975 | Suska . |
| 3,991,436 | 11/1976 | Nagase . |
| 3,999,246 | 12/1976 | Suska . |
| 4,056,985 | 11/1977 | Worrallo . |
| 4,097,959 | 7/1978 | Johnson . |
| 4,284,861 | 8/1981 | Senften . |
| 4,330,158 | 5/1982 | Walters . |
| 4,413,918 | 11/1983 | Thomas . |
| 4,419,788 | 12/1983 | Prout . |
| 4,443,911 | 4/1984 | Bannister . |
| 4,444,240 | 4/1984 | Bannister . |
| 4,475,266 | 10/1984 | Suska . |
| 4,477,941 | 10/1984 | Gregg . |
| 4,479,753 | 10/1984 | Thorley . |
| 4,583,262 | 4/1986 | Werner . |
| 4,606,394 | 8/1986 | Bannister . |
| 4,614,454 | 9/1986 | Kassai . |
| 4,630,332 | 12/1986 | Bisbing . |
| 4,679,277 | 7/1987 | Shibata . |
| 4,761,853 | 8/1988 | Hoffman . |
| 4,765,027 | 8/1988 | Andric . |
| 4,807,330 | 2/1989 | Gomes . |
| 4,907,289 | 3/1990 | Kamimura et al. . |
| 5,062,181 | 11/1991 | Bobrowski et al. . |

FOREIGN PATENT DOCUMENTS

| | | |
|---|---|---|
| 679178 | 10/1984 | Canada . |
| 2457413 | 3/1975 | Germany . |

*Primary Examiner*—Chuck Y. Mah

[57] ABSTRACT

A multiple piece thrust bearing assembly for a hinge structure having two hinge members and a clamp member. The hinge members are rotatably joined along their adjacent longitudinally extending edges by intermeshing gear segments which are held together by the clamp member to permit smooth and uniform movement of the hinge members. The multi-piece thrust bearing assembly of the present invention comprises a thrust bearing member and bearing inserts arranged between the thrust bearing member and each of the hinge members for improving durability of the thrust bearing assembly and, thereby the hinge structure. The thrust bearing member of the bearing assembly is formed from a non-metallic material which extends laterally across the hinge members to inhibit their longitudinal movement relative to each other. A first or upper pair of non-metallic bearing inserts are arranged between an upper bearing surface of the thrust bearing member and each of the hinge members to reduce frictional sliding contact therebetween. A second or lower pair of non-metallic bearing inserts are arranged between a lower bearing surface of the thrust bearing and each of the hinge members to further reduce frictional sliding contact therebetween.

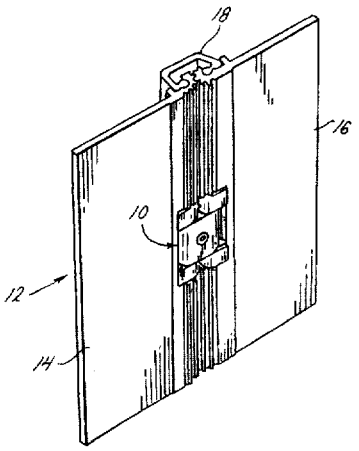

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *